United States Patent [19]

Bortoli

[11] 4,264,087

[45] Apr. 28, 1981

[54] SKI-BINDING SUPPORT

[76] Inventor: Ettore Bortoli, 6, Via Calabria, Thiene, Vicenza, Italy

[21] Appl. No.: 34,798

[22] Filed: Apr. 30, 1979

[30] Foreign Application Priority Data

May 4, 1978 [IT] Italy ..... 85552 A/78

[51] Int. Cl.[3] ..... A63C 9/08

[52] U.S. Cl. ..... 280/633; 280/636

[58] Field of Search ..... 280/607, 618, 633, 636; 24/81 SK; 211/60 SK; 292/155

[56] References Cited

U.S. PATENT DOCUMENTS 4,160,556 7/1979 Gertsch ..... 280/633 X

FOREIGN PATENT DOCUMENTS 920242 12/1971 Italy .

340170 9/1959 Switzerland ..... 280/636

407625 3/1934 United Kingdom ..... 292/155

*Primary Examiner*—John J. Love

*Assistant Examiner*—Michael Mar

*Attorney, Agent, or Firm*—William A. Drucker

[57] ABSTRACT

A ski-binding support plate includes a one-piece center body, having a longitudinal groove, and projecting side guides for insertion of a sliding-type front or rear binding for boots. Jaws protrude on each side of the body, with limbs folded downwards and fitted at the ends with thin projections, facing inwards, which penetrate into grooves made on the sides of the ski, which makes it possible to move the plate on the ski in order to set the binding in a new position, according to the user's requirements.

2 Claims, 7 Drawing Figures

SKI-BINDING SUPPORT

OBJECT OF THE INVENTION

The object of the present invention is to provide a universal support plate, suitable for application to a ski, to support a front binding or a rear binding, the improvement of which is the possibility of being applied to skis of any width, as well as of being moved easily by the user himself, e.g. to adjust the position of the bindings to different boot sizes or to a different position required by the same user.

BACKGROUND OF THE INVENTION

As is known, one of the drawbacks encountered in fixing either the front or rear bindings of a ski lies in the fact that wood screws have to be inserted into holes suitably pre-positioned in the ski, which involves the need to carry out complicated re-drilling, with not inconsiderable aesthetic and other effects, if the position of the binding has to be changed to suit the user's requirements.

THE PRIOR ART

An initial attempt to overcome this drawback was made by the applicant in Italian Pat. No. 920,242, which disclosed a two-part stirrup for fixing either a front or a rear binding to the ski without screws, each element of which was fitted with a limb folded downwards on the side of the ski and ending in a projection folded inwards, which penetrated into a groove formed horizontally in the same side.

The two elements were held together by screws, by tightening which the stirrup was held to the ski in the required position, which could easily be changed to meet the user's requirements.

Nevertheless, the solution described above had the drawback of comprising a variation in the distance between centres of the holes pre-arranged in the elements of the stirrup, if fitted on skis of different widths, which made it necessary to have available a set of bindings of different sizes, on the basis of the different widths of the skis, where the bindings themselves could be fitted.

With the advent of new bindings with sliding engagement, it become even more urgently necessary to have a plate of standardised type, suitable to support any type of binding wih sliding engagement, regardless of variations in the width of the skis to which such plates were to be fixed, and moreover eliminating the need to make binding-holes in the ski.

SUMMAY OF THE INVENTION

According to the present invention, the stirrup, of standardised dimensions and a shape such as to allow the fixing of any type of binding with sliding insertion, both rear and front, is fitted at the bottom with two jaws whose position in relation to the stirrup can easily be adjusted by operating set-screws, accessible on the sides of the stirrup, in such a way as to be able to grip, with the downward-folded limbs, a groove made in each side of the ski, forming a powerful vice which fixes the plate to the ski, whatever its width may be, within certain width limits.

The two fixing screws, one for each jaw, can be adjusted independently of each other in order to allow the stirrup to be fixed on to the ski even in a position which is not perfectly axial, as in some cases may be demanded by the particular requirements of the user.

The mere unscrewing even of only one of said screws causes the loosening of the vice on the ski and consequently makes it possible to move a binding to a new position, as may be required by the user.

BRIEF DESCRIPTION OF THE DRAWINGS

An embodiment of the invention will now be described in greater detail with reference to the accompanying drawings, wherein.

DESCRIPTION OF THE PREFERRED EMBODIMENT

Figure 1:
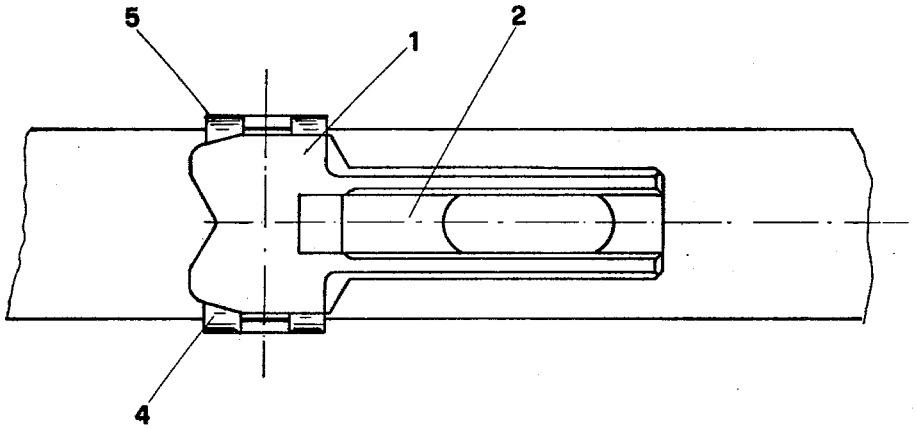
FIG. 1 is a view from above of a support plate, made according to the invention and mounted on a ski, part of which can be seen.
Figure 2:
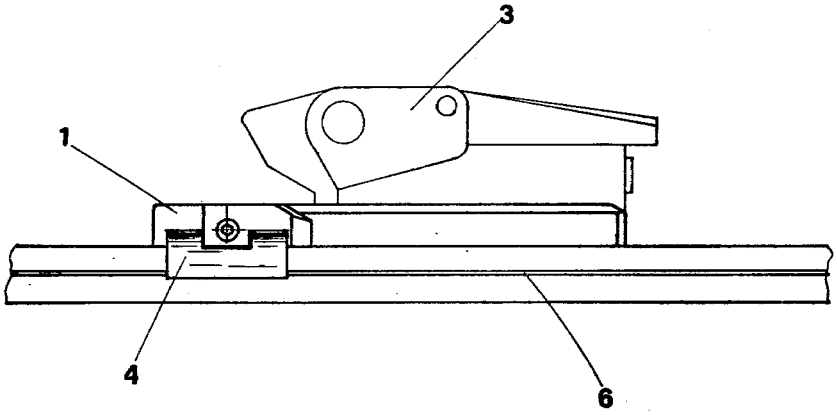
FIG. 2 is a side view of the same with, drawn in faint line, a type of rear binding for skis applied thereon.

In the embodiment of the invention illustrated in the drawings, the plate includes a single, one-piece centre body 1, of such a width as to be able to be contained in the plane of the narrowest ski within the range of widths for application of the plate, and has a longitudinal groove 2, with projecting side guides for the introduction of a binding 3 with standard-type sliding fixing, shown diagrammatically in faint line in FIG. 2.

From each side of body 1, jaws 4 and 5 protrude, with limbs folded downwards and fitted at the end with thin and possibly notched projections, facing inwards, which penetrate into grooves 6 made in the sides of the ski by means already described in the aforesaid Italian Pat. No. 920,242.

Figure 3:
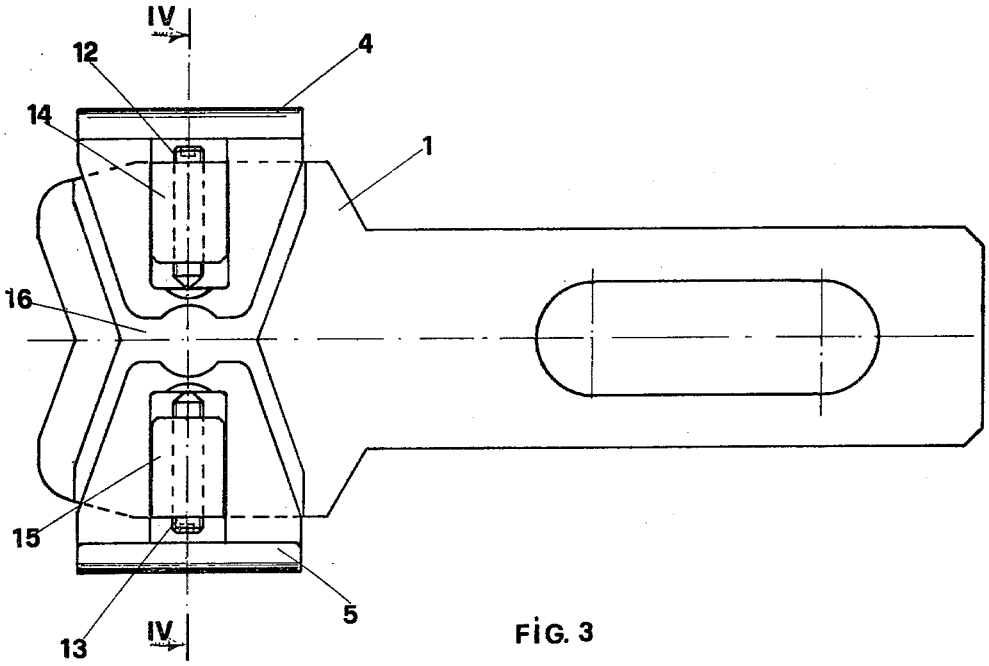
FIG. 3 is a view from below of the plate, with the jaws open to a certain extent.
Figure 4:
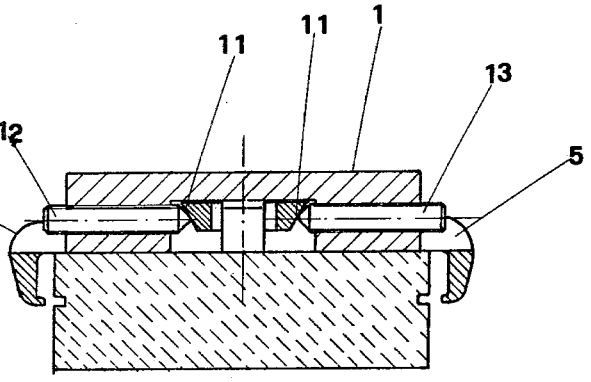
FIG. 4 is a cross section taken along the line IV—IV of FIG. 3.
Figure 5:
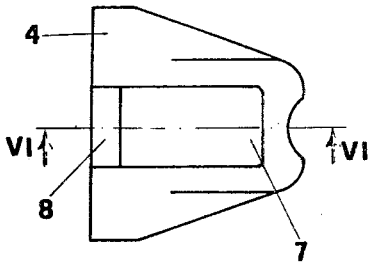
FIG. 5 is a view from above of a plate-locking jaw, shown separately.
Figure 6:
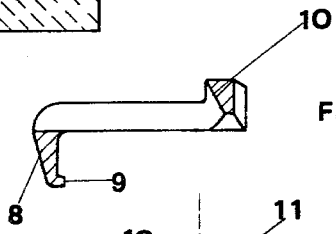
FIG. 6 is a side view, in section taken along the line VI—VI in FIG. 5, of the same.
Figure 7:
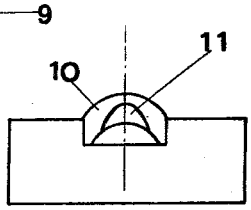
FIG. 7 shows a front view of the same.

As can be seen in FIGS. 5, 6 and 7, each jaw 4 or 5 has a roughly rectangular hole 7, closed on one side by limb 8, folded downwards, with end projection 9 facing inwards, and on the other by the semi-circular bridge 10, with sloping inner surface 11, against which press the ends of set-screws 12 and 13 (FIGS. 3 and 4) which tighten the jaws on the ski.

Screws 12 and 13 are screwed into holes made in projections 14 and 15 situated within an X-shaped cavity 16 made on the underside of body 1.

Screwing of set-screws 12 and 13 pushes jaws 4 and 5 towards the centre, making it possible to fix the plate to the ski, as can be seen in FIG. 4.

Inclined planes 11, against which the rounded end of each set-screw 12 or 13 is applied, raise the horizontal limb of each jaw against the bottom wall of X-shaped groove 16, further stabilizing the position of the jaws locked on the sides of the ski.

Extremely rigid and secure fixing of the plate to the ski is consequently obtained, as required for the binding mounted on the plate to be perfectly stable.

The unscrewing even of only one of the two set-screws 12 or 13 causes the loosening of jaws 4 or 5 and consequently makes it possible to move the plate on the ski in order to set the binding in a new position according to the user's requirements.

By unscrewing one of the two set-screws and screwing the other, it is possible to move the binding plate transversally to the ski, to obtain a new, possibly offset binding position to meet the user's particular requirements.

Obviously, the constructional details of the universal support plate now described have been illustrated in the drawings in one particular form of constructional embodiment, given merely as a non-limiting example, and these may assume various shapes and aspects, the essential characteristics of the invention remaining unchanged, without thereby departing from the scope of the appended claims.

I claim:

1. A support plate, for front and rear ski bindings, comprising:

(i) a one-piece component having in an upper face thereof a groove which, in the position of use of the component mounted on a ski, is positioned longitudinally of the ski for receiving a sliding ski binding, said component having in a lower face thereof a transverse recess extending to each side face of the component (ii) a pair of movable jaws disposed in said recessing and slidably guided for transverse movement therein, each said jaw projecting from a respective side face of the component and having on its projecting portion a downwardly extending limb at the lower end of which there is an inwardly-facing longitudinal end projection adapted to engage into a respective longitudinal groove in a side of the ski (iii) a pair of set screws threadedly engaged in the component and positioned transversely thereof, each set screw abutting a respective jaw for forcing the jaw transversely inwards on the component such that its end projection may become engaged and tightened in the groove of the ski, whereby the support plate may be clamped by said jaws onto the ski.

2. A support plate, as claimed in claim 1, wherein each said jaw includes a bridge portion having an inclined surface against which an end of the respective set screw abuts, the inclination of said surface being such that abutment of the set screw against the surface to move the jaw inwardly urges said bridge portion against a face of said component bounding said transverse recess, thereby to increase the rigidity of the clamping action of the jaws.

* * * * *